US007051442B2

(12) United States Patent
McCambridge et al.

(10) Patent No.: US 7,051,442 B2
(45) Date of Patent: May 30, 2006

(54) EAR AREA COMB ATTACHMENT FOR HAIR CLIPPER

(75) Inventors: James E. McCambridge, Polo, IL (US); Scott A. Melton, Erie, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 10/459,680

(22) Filed: Jun. 11, 2003

(65) Prior Publication Data

US 2004/0250429 A1 Dec. 16, 2004

(51) Int. Cl.
*B26B 19/02* (2006.01)

(52) U.S. Cl. ..... 30/233; 30/289

(58) Field of Classification Search ..... 30/200–202, 30/55, 233.5, 195, 81, 82, 233, 289
See application file for complete search history.

(56) References Cited

U.S. PATENT DOCUMENTS

| | | | | | |
|---|---|---|---|---|---|
| 356,434 | A * | 1/1887 | Washburn | 30/202 |
| 869,500 | A * | 10/1907 | Martin | 30/200 |
| 2,882,595 | A * | 4/1959 | Hall | 30/201 |
| 2,896,323 | A * | 7/1959 | Guerra et al. | 30/201 |
| 2,916,820 | A * | 12/1959 | Clark | 30/201 |
| 3,030,707 | A * | 4/1962 | Garvey | 30/537 |
| 3,178,815 | A * | 4/1965 | Madrid | 30/286 |
| 4,125,940 | A * | 11/1978 | Ihasz et al. | 30/220 |
| 5,050,305 | A * | 9/1991 | Baker et al. | 30/201 |
| 5,937,526 | A * | 8/1999 | Wahl et al. | 30/201 |
| 6,427,337 | B1 * | 8/2002 | Burks | 30/200 |
| 2003/0233754 | A1 * | 12/2003 | Braun et al. | 30/201 |

FOREIGN PATENT DOCUMENTS

| | | |
|---|---|---|
| AU | 508647 A | 6/1978 |
| GB | 2 266 259 A | 10/1993 |

OTHER PUBLICATIONS

Admitted Prior Art I —Fig. 1, undated.
Admitted Prior Art I—Fig. 2, undated.

* cited by examiner

*Primary Examiner*—Kenneth E. Peterson
(74) *Attorney, Agent, or Firm*—Greer, Burns & Crain, Ltd.

(57) ABSTRACT

An ear area comb attachment for attachment to a hair clipper having a bladeset with a moving blade laterally reciprocating relative to a stationary blade includes a base configured for attachment to the clipper and a guard formation associated with the base for blocking access to a central portion of the bladeset and defining a cutting area at at least one end portion. At least one hair feed guide is associated with the base for guiding hair strands toward the cutting area.

18 Claims, 7 Drawing Sheets

EAR AREA COMB ATTACHMENT FOR HAIR CLIPPER

BACKGROUND OF THE INVENTION

The present invention relates generally to hair clipping devices, whether manually operated or powered. Specifically, the present invention relates to such trimming devices intended for use in trimming the hair around one's ears.

It is well known to use a powered hair trimmer or hair clipper for trimming the hair, either at home or by a barber or hair stylist. One aspect of hair styling is the trimming of hair which has grown over the ears. For those desiring a shorter hairstyle, this hair is usually removed so that the hair line totally clears the peripheral margin of the ear, particularly the upper margin.

One challenge of using conventional clippers for this purpose is that the ear area must be made clear of stray hair without clipping the ear itself. In addition, in trimming the ear hair, care needs to be taken to prevent clipping adjacent areas of the head in a way which provides an uneven appearance. Typically, the clipper must be carefully positioned to achieve the goals of ear area trimming while maintaining the overall taper of the hairstyle. Inexperienced stylists or home users often hold the clipper at an inappropriate angle which increases the chances of obtaining poor results around the ear area, or accidentally cutting portions of the ear.

Thus, there is a need for a device for trimming the hair around the ear which facilitates the clipping of any hair overlying the ear, and also protects the ear from inadvertent clipping. In addition, there is a need for such a device which prevents the inadvertent clipping of hair while the ear area is trimmed.

BRIEF SUMMARY OF THE INVENTION

The above-identified needs are addressed by the present ear area comb attachment for a hair clipper, which is removably attachable to a conventional hair trimmer or hair clipper blade end. The attachment of the present device is similar to that of a conventional attachment comb. One feature of the present attachment is a hair feed guide configured for gathering hair overlying the ear and guiding it into the exposed clipping blades. Another feature is a blade guard for obscuring, masking or blocking a significant portion of the width of the cutting edge of the conventional wide clipper blade, and revealing only a relatively small portion of the blades for access to the ear area. In this manner, the user's ears as well as the hair above the user's ears is protected from the moving clipper blades. Another optional feature of the present ear area attachment comb is that provisions are made for trimming both left and right ears.

More specifically, the present invention provides an ear area comb attachment for attachment to a hair clipper having a bladeset with a moving blade laterally reciprocating relative to a stationary blade. The attachment includes a base configured for attachment to the clipper and a guard formation associated with the base for blocking access to a central portion of the bladeset and defining a cutting area at at least one end portion. At least one hair feed guide is associated with the base for guiding hair strands toward the cutting area. In the preferred embodiment, the hair feed guide is configured for guiding the hair laterally toward the blade area.

In another embodiment, an ear area comb attachment for attachment to a hair clipper having a bladeset with a moving blade laterally reciprocating relative to a stationary blade, includes a base configured for attachment to the clipper and having a pair of ends and a pair of hair feed guides associated with the base for guiding hair strands disposed over the ear and defining a cutting area therebetween, each the hair feed guide associated with a respective one of the ends configured for guiding hair strands toward the cutting area.

DETAILED DESCRIPTION OF THE INVENTION

Figure 1:
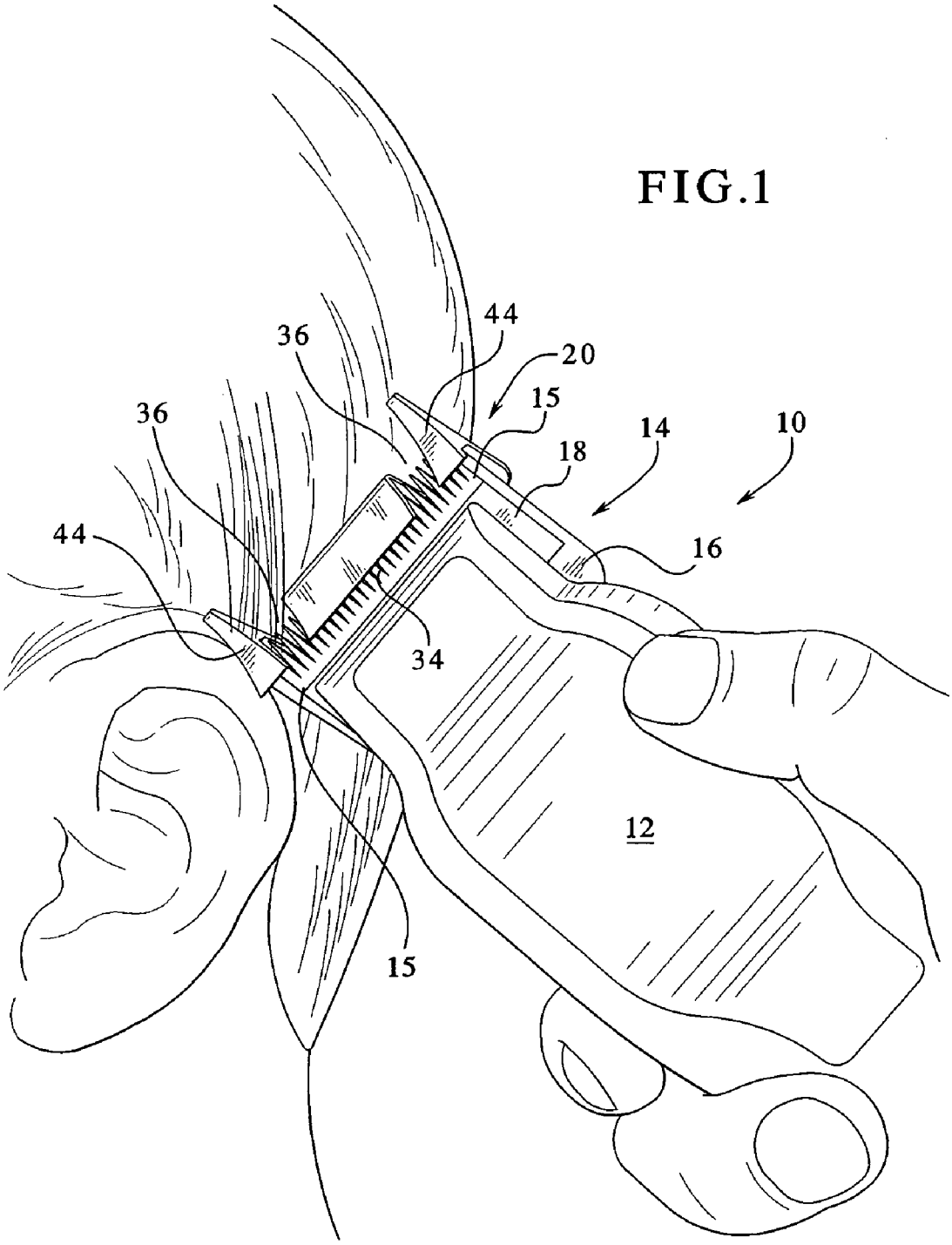
FIG. 1 is an elevational view of a powered hair clipper fitted with the present ear area comb attachment and being used on a users' ear area.

Referring now to FIG. 1, a powered hair clipper or hair trimmer (here used interchangeably) suitable for use with the present attachment is generally designated 10. Included on the clipper 10 is a housing 12 enclosing a power source (not shown) preferably an electric motor, powered by line voltage or batteries as is well known in the art. While a powered hair clipper 10 is depicted, it is contemplated that the present attachment is usable on manually operated clippers as are known in the art. One end of the housing 12 is the mounting point for a bladeset 14 having a pair of bladeset ends 15 and formed by a stationary blade 16 and a moving blade 18. Cutting is performed by lateral reciprocal movement of the moving blade 18 relative to the stationary blade 16, which results in a scissors action. Both of the blades 16, 18 have a plurality of teeth, and the reciprocal movement of the blades causes cutting action along a cutting line extending the width of the blades. As is known in the art, such clippers 10 are widely used for personal grooming such as hair cutting, beard and mustache trimming and ear area trimming.

For facilitating ear area trimming, and for addressing some of the above-identified needs, the present ear area comb attachment 20 is releasably attachable to the bladeset 14, preferably to the stationary blade 16. The attachment 20 is specifically designed to promote the movement of hair overlying the ear toward the bladeset 14 for accurate trimming while avoiding nicking the ear. In addition, the inadvertent trimming of the hair above the general ear area is prevented. In the preferred embodiment, the attachment 20 is integrally molded from a suitably durable plastic material, however other materials are contemplated as are known in the art.

More specifically, and referring to FIGS. 2–5, the attachment 20 includes a base 22 which is generally planar and configured for attachment to the clipper 10. A rear 24 of the base 22 is provided with a connection formation preferably including a latch wall 26 projecting in a generally perpendicular direction from the base and having a latch lug 28 for frictional and preferably releasable engagement upon the stationary blade 16. In the preferred embodiment, to save material, the base 22 is gradually tapered toward the rear 24. To facilitate the attachment and/or detachment as desired of the attachment 20 upon the bladeset 14, a gripping formation 30 is provided upon an exterior surface of the latch wall 26.

A guard formation 32 is associated with the base 22 for blocking access to a central portion 34 (FIG. 1) of the bladeset 14 and defining a gap or a cutting area 36 at at least one end portion 38. Each end portion 38 is associated with corresponding ends 15 of the bladeset 14. For a clipper bladeset with a width of about 1.5 inches, each cutting area 36 is preferably in the range of ¼–5⁄16 inch wide. However, the size of the cutting area is variable to suit the application.

Figure 5:
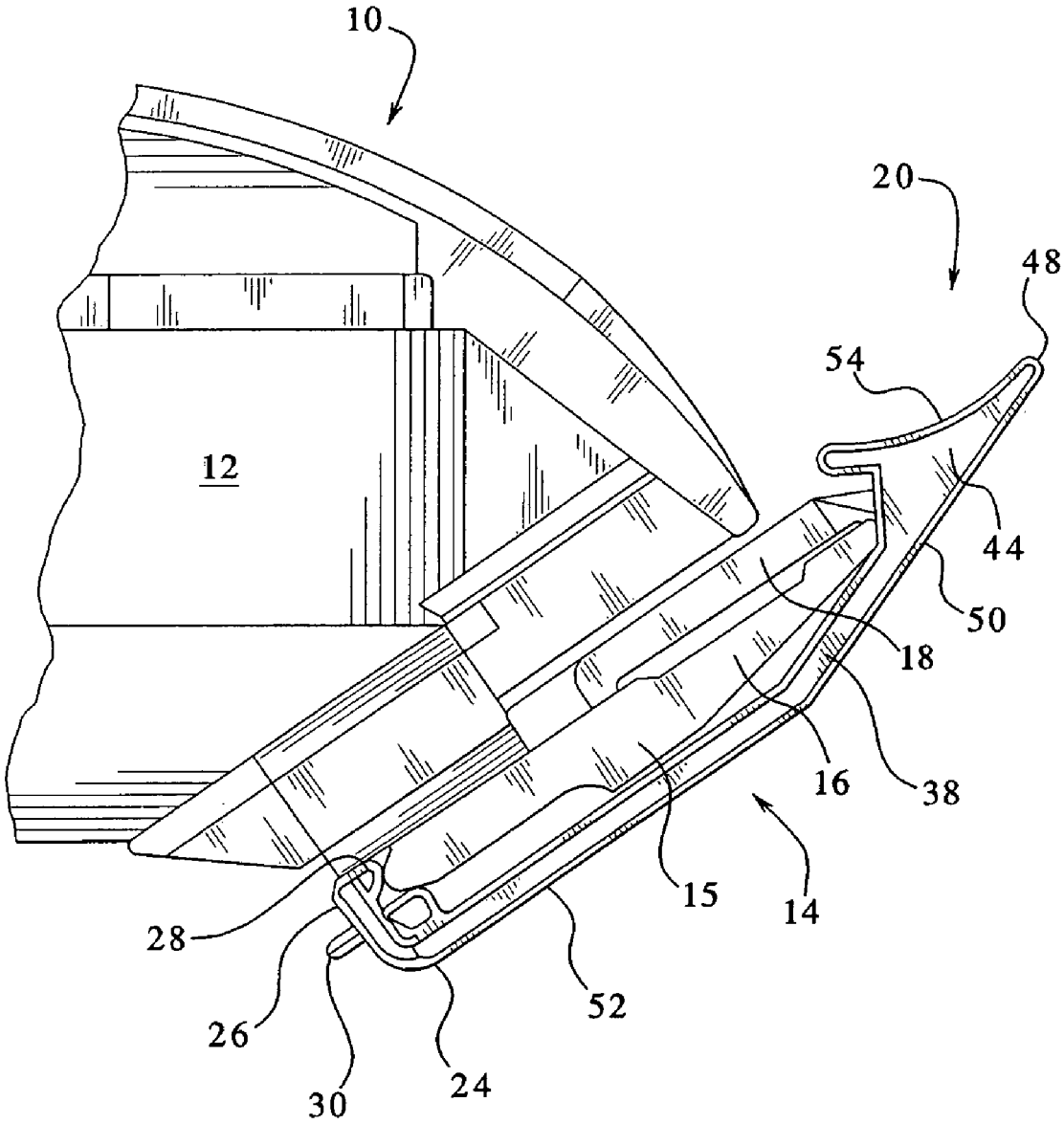
FIG. 5 is a side view of the present attachment shown mounted on a clipper.

The guard formation 32 preferably has a curved or radiused leading edge 40 and is generally wedge-shaped when viewed from the side, which generally corresponds to the profile of cutting portion of the bladeset 14 (FIG. 5). In addition, the guard formation 32 substantially covers the bladeset 14 and prevents access to the blades 16, 18 except in the cutting areas 36. However, it will be appreciated that the guard formation 32 will not be so close to the moving blade 18 to impair the cutting action. Thus, the guard formation 32 prevents the unintentional trimming of above the ear area hair, and also guards against accidental ear nicking.

Figure 2:
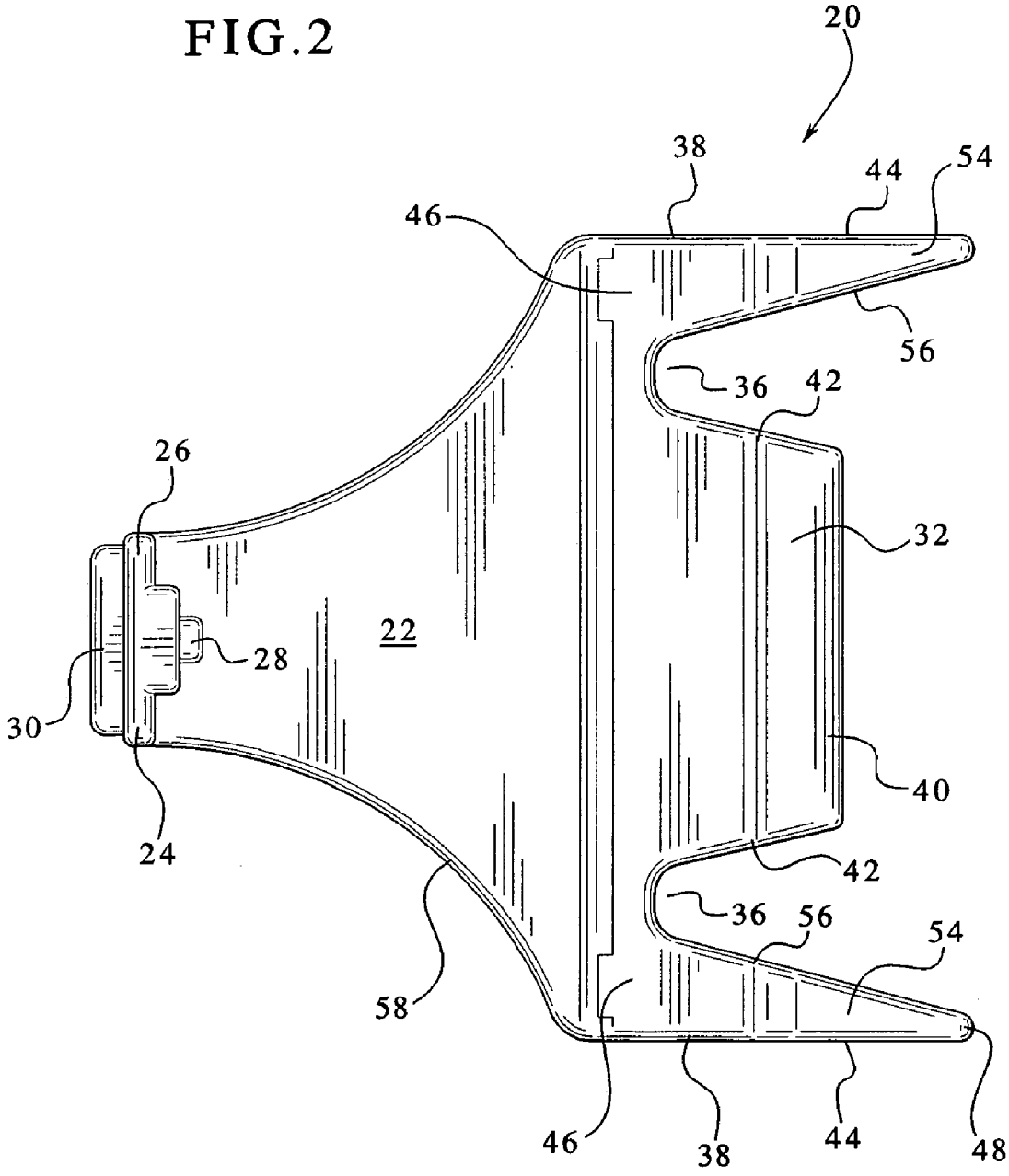
FIG. 2 is an overhead plan view of the attachment shown in FIG. 1.
Figure 3:
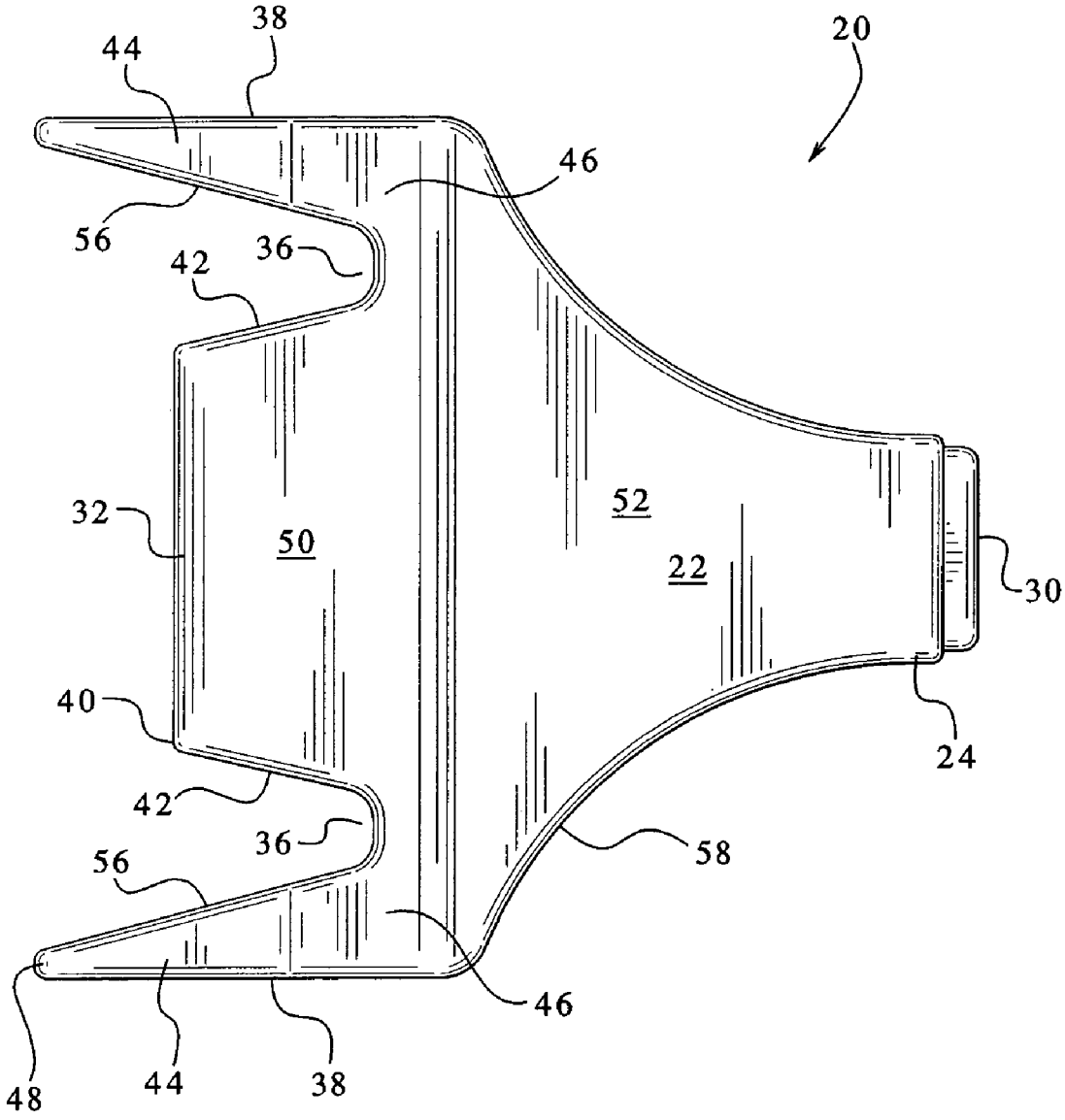
FIG. 3 is a bottom plan view of the attachment shown in FIG. 2.
Figure 4:
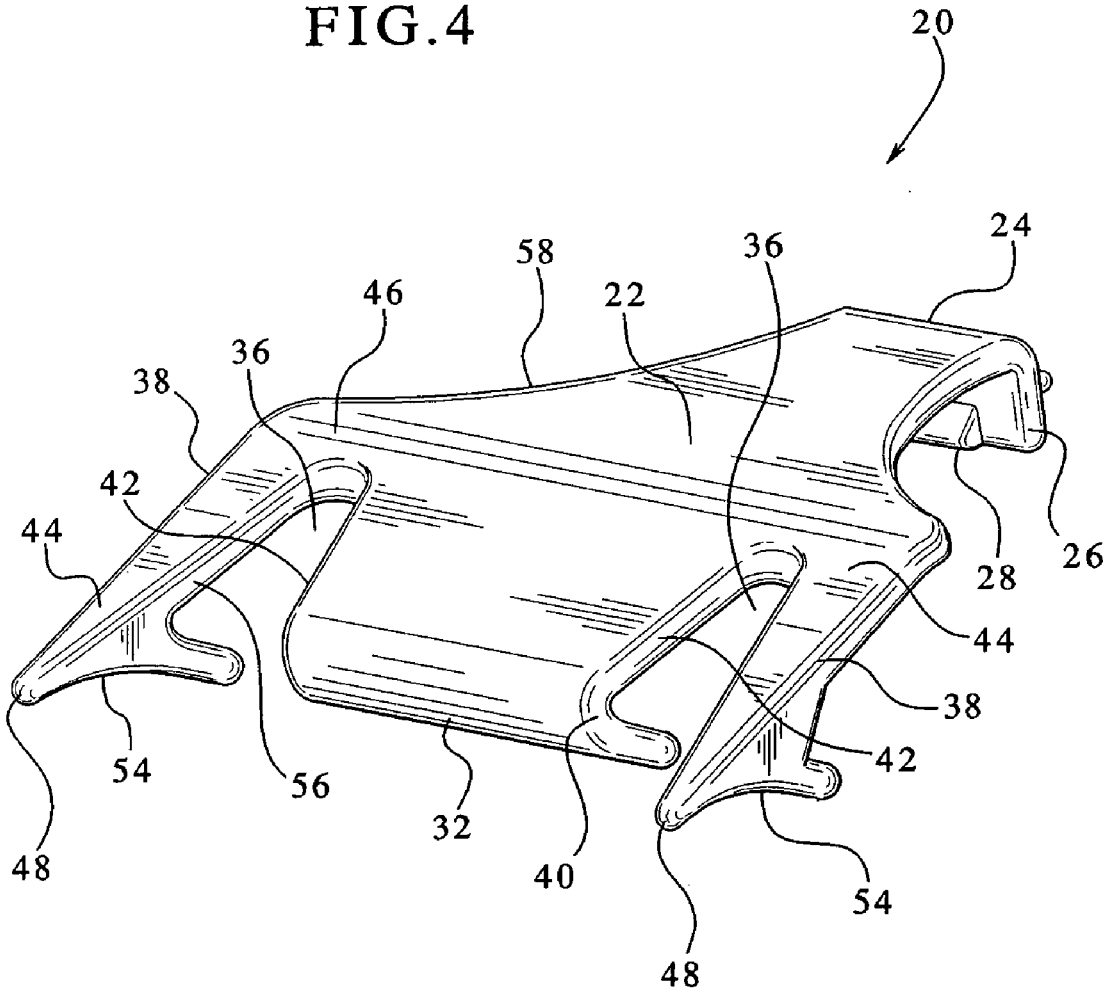
FIG. 4 is a bottom perspective view of the attachment of FIG. 3.

Referring now to FIGS. 2–4, the cutting area 36 is preferably "V"-shaped, with one leg of the V being formed by an edge 42 of the guard formation 32, and the other by a hair feed guide 44 associated with the base 22 for guiding hair strands toward the cutting area. In the preferred embodiment, the hair feed guide 44 is configured for guiding hair strands, particularly those hair strands overlying the ear, into the cutting area 36 so that the hair can be cut by the blades 16, 18.

Each of the preferably two hair guides 44 has a root 46 preferably integrally joined to the base 22 and being generally wider than a tip 48 at the opposite end. Thus, the guide 44 tapers from the root 46 to the tip 48. Two guides 44 and two cutting areas 36 are preferably provided so that the attachment 20 can readily be used on both left and right ears. A generally planar bottom surface 50 of the guard formation 32 is generally coextensive with a bottom 52 of the base 22, however in the preferred embodiment, the bottom surface 50 is oriented at an inclined angle relative to the base 22 (FIG. 5) to better envelop the blades 16, 18. The amount of inclination of the bottom surface 50 may vary to suit the application or the particular clipper 10. Also, while it is preferred that the attachment 20, including the base 22, the guard formation 32 and the hair guide 44 is molded as an integral unit, the attachment of various of the above-identified components as separate elements by adhesive, ultrasonic welding or other fastening technologies is contemplated.

Referring now to FIGS. 1, 2 and 5, an upper surface 54 of the guide 44 is preferably curved from the tip 48 upwardly or away from the guide to a point approximately midway between the tip and the root 46. This curved surface 54 facilitates the lifting of the hair strands away from the ear, and at the same time, an inner surface 56 progressively guides the lifted hair strands toward the cutting area 36. In the preferred embodiment, the surface 56 is angled or tapered from the tip 48 toward the cutting area 36

It will be seen that an important advantage of the present guide 44 is that hair strands are guided laterally toward the cutting area 36. Thus, each hair feed guide 44 is configured to extend generally normal to a cutting line defined by the blades 16, 18 of the clipper 10, the hair feed guides extending farther in front of the bladeset 14 than any other structure of the attachment 20 for guiding hair laterally into the cutting area. It has been found that the tapered surface facilitates rapid, relatively low-friction movement of hair strands toward the cutting area 36. Also, to minimize the snagging of the attachment 20 in the hair, the cutting area 36 as well as a peripheral edge 58 and the guard formation 32 are all provided with a radiused or rounded configuration. Further, and referring to FIG. 1, the attachment 20 allows the clipper 10 to be oriented at a more perpendicular angle to the user's head as compared to clipper orientation when normal trimming is performed. Such an orientation enhances the advantages of the present attachment 20 and obtains more desirable results.

Figure 6:
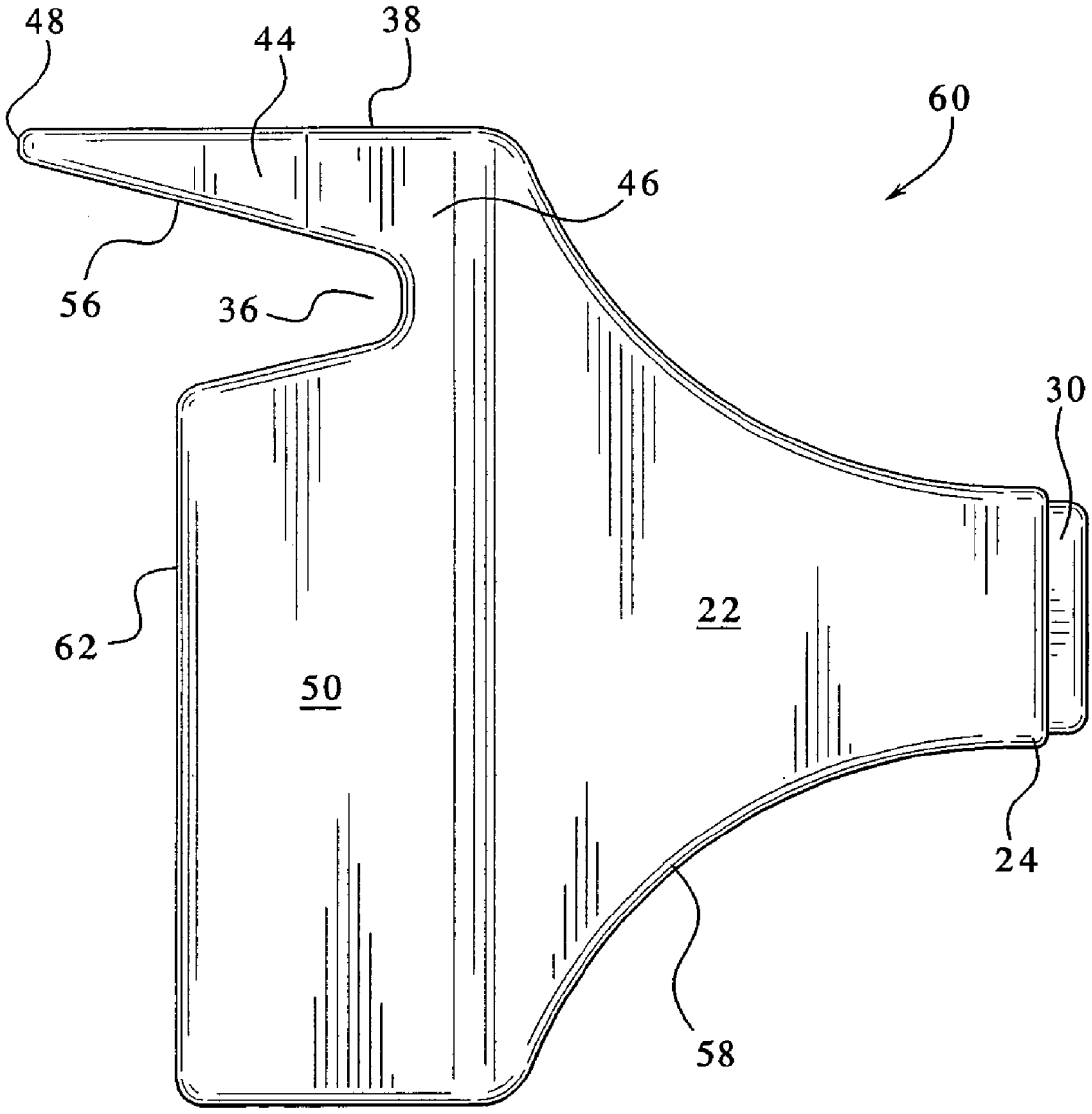
FIG. 6 is a bottom plan view of an alternate embodiment of the attachment of FIG. 1.

Referring now to FIG. 6, while it is contemplated that the attachment 20 can be used for either right or left ears, depending on which side of the attachment is employed, it is also envisioned that an alternate embodiment, generally designated 60, is provided with only one guide formation. The attachment 60 differs from the attachment 20 in the lack of a second hair guide 44. In its place, an extended guard formation 62 extends to the end 38 of the attachment 60 for preventing the accidental cutting of hair by the bladeset 14 at that end. As such, all components which correspond to the attachment 20 have been assigned the same reference number. It is also contemplated that the single guide 44 may be provided on either the left or right side of the attachment 60.

Figure 7:
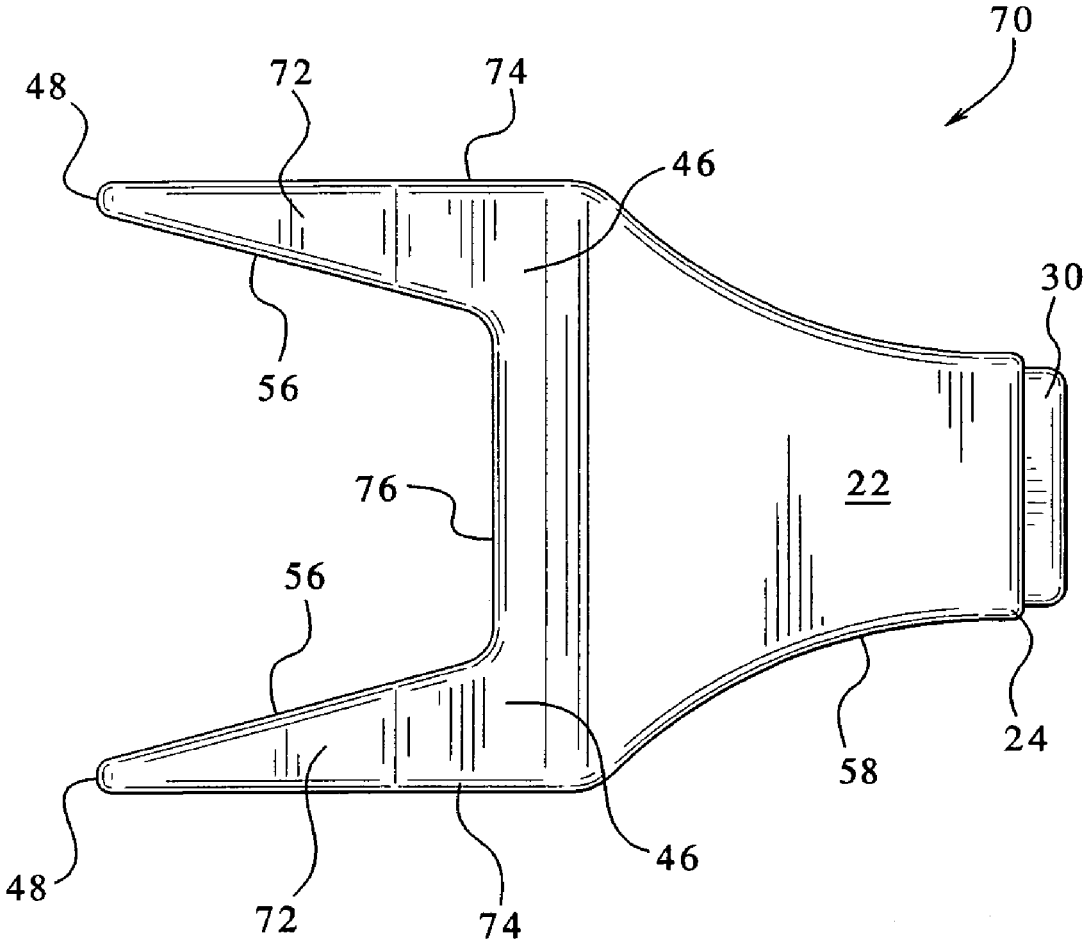
FIG. 7 is a bottom plan view of a second alternate embodiment of the attachment of FIG. 1.

Referring now to FIG. 7, another alternate embodiment of the attachment is generally designated 70. Features of the attachment 70 which are shared with the attachment 20 are designated with the same reference number. While the attachment 20 is generally configured for standard clippers 10, in the event a clipper or a trimmer has a narrower bladeset 14 and is used for ear area trimming, it is contemplated that the guard formation 32 is eliminated, leaving a pair of spaced guides 72 each located adjacent a corresponding end 74 and defining a relatively wider cutting area 76 therebetween. It is contemplated that while the cutting area is relatively wider, the relatively narrower spacing of the hair guides 72 is sufficient to prevent unwanted ear nicking and/or inadvertent hair trimming.

Thus, it will be seen that the present attachments 20, 60 and 70 facilitate the use of a standard clipper 10 for trimming ear areas. Hair strands are lifted and moved laterally toward a restricted cutting area. The small size of the cutting area reduces the chances of ear nicking and inadvertent hair trimming. Radiused edges facilitate the movement of the attachment through the hair and prevent snagging. While the present specification is directed to the use of the attachments 20, 60 and 70 for ear area trimming, it is contemplated that these attachments could be used in any hair trimming application in which hair is lifted away from the skin for trimming, such as, but not restricted to trimming of bangs.

While a particular embodiment of the present ear area comb attachment for a hair clipper has been described herein, it will be appreciated by those skilled in the art that changes and modifications may be made thereto without departing from the invention in its broader aspects and as set forth in the following claims.

The invention claimed is:

1. An ear area comb attachment for attachment to a hair clipper having a bladeset with a moving blade laterally reciprocating relative to a stationary blade, comprising:

a base configured for attachment to the clipper and having a pair of ends associated with the bladeset;

a hair feed guide located at a corresponding one of at least one of said ends on said base and defining a cutting area between said ends wherein the blades are exposed, said feed guide configured for guiding hair strands toward said cutting area;

a guard formation associated with said base for blocking access to a central portion of the bladeset between said ends by covering a majority of said bladeset so that said cutting area is accessible to hair only between corresponding ends of said guard formation and said ends of said base, said hair feed guide extending farther in front of the bladeset generally along a plane defined by at least one of the blades than said guard formation; and said guard formation has a curved leading edge forming a general wedge shape when viewed from a side of the clipper, said general wedge shape having two portions normally displaced from each other relative to said base and defining a space between them.

2. The attachment of claim 1 wherein said at least one hair feed guide tapers from said base to a tip.

3. The attachment of claim 2 wherein said at least one hair feed guide has a curved upper surface.

4. The attachment of claim 1 wherein said at least one hair feed guide is configured for gathering and guiding hair laterally toward said cutting area.

5. The attachment of claim 1 wherein said cutting area is formed as a generally "V"-shaped gap when viewed from below is defined between said at least one hair feed guide and said guard formation.

6. The attachment of claim 1 further including a pair of said hair feed guides, each said guide being associated with each said end of said base, and a gap defined between each said hair feed guide and adjacent ends of said guard formation.

7. The attachment of claim 1 further including a connection formation for releasably connecting said at least one guard formation to the stationary blade.

8. The attachment of claim 7 further including at least one gripping formation for facilitating the removal of said attachment from the clipper.

9. The attachment of claim 1 wherein said at least one hair feed guide has an inner surface configured for facilitating the movement of hair laterally towards said cutting area.

10. The attachment of claim 1 wherein said cutting area is adjacent each of said ends of said base.

11. An ear area comb attachment for attachment to a hair clipper having a bladeset with a moving blade laterally reciprocating relative to a stationary blade, comprising:

a base configured for attachment to the clipper and having a pair of ends;

a pair of hair feed guides associated with said base, configured for guiding hair strands disposed over the ear and defining a cutting area therebetween, each said hair feed guide associated with a respective one of said ends configured for guiding hair strands toward said cutting area;

upon attachment to the clipper, each said hair feed guide extends generally normal to a cutting line defined by blades of the clipper, and extending farther in front of the bladeset generally along a plane defined by at least one of the blades than any other structure of said attachment for guiding hair laterally into said cutting area; and a guard formation associated with said base and blocking access to a central portion of the bladeset between said ends so that the bladeset is accessible to hair only between corresponding ends of said guard formation and said hair feed guides, said guard formation has a curved leading edge forming a general wedge shape when viewed from a side of the clipper, said general wedge shape having two portions normally displaced from each other relative to said base and defining a space between them, said central portion comprising a majority of said blade set.

12. The attachment of claim 11 wherein each said hair feed guide has a tip and is configured to taper from said tip to said cutting area.

13. The attachment of claim 11 wherein each said hair feed guide is configured for guiding hair laterally into said cutting area.

14. The attachment of claim 13 wherein said cutting area is formed as a generally "V"-shaped gap when viewed from below and is defined between said at least one hair feed guide and said guard formation.

15. The attachment of claim 11 wherein said at least one hair feed guide has a curved upper surface.

16. The attachment of claim 15 wherein each said hair feed guide has a tip, and said curved surface extends from said tip toward a root of said guide.

17. The attachment of claim 11 wherein said cutting area is located adjacent said guide formation.

18. An ear area comb attachment for attachment to a hair clipper having a bladeset with a moving blade laterally reciprocating relative to a stationary blade and defining a cutting line, comprising:

a base configured for attachment to the clipper and having a pair of ends;

a guard formation associated with said base and having a curved leading edge forming a general wedge shape when viewed from a side of the clipper, said general wedge shape having two portions normally displaced from each other relative to said base and defining a space between them, said guard formation blocking access to a central portion of said blade set, said central portion comprising a majority of said blade set;

a pair of hair feed guides associated with said base, configured for guiding hair strands disposed over the ear and defining a cutting area therebetween, each said hair feed guide associated with a respective one of said ends configured for guiding hair strands toward said cutting area; and upon attachment to the clipper, each said hair feed guide extends generally normal to a cutting line defined by blades of the clipper, and extending farther in front of the bladeset generally along a plane defined by at least one of the blades than any other structure of said attachment for guiding hair laterally into said cutting area.

* * * * *